United States Patent [19]

Wismer et al.

[11] 4,070,497

[45] Jan. 24, 1978

[54] PROCESS OF APPLYING AND CURING A PLURALITY OF COATINGS

[75] Inventors: Marco Wismer, Gibsonia, Pa.; Gene Gerek, Franklin, Mich.

[73] Assignee: PPG Industries, Inc., Pittsburgh, Pa.

[21] Appl. No.: 338,462

[22] Filed: Mar. 6, 1973

Related U.S. Application Data

[63] Continuation-in-part of Ser. No. 122,433, March 9, 1971, abandoned.

[51] Int. Cl.[2] ..... B05D 3/06

[52] U.S. Cl. ..... 427/44; 204/159.15; 204/160.1; 427/54

[58] Field of Search ..... 117/93.31; 204/159.11, 204/159.15, 160.1

[56] References Cited

U.S. PATENT DOCUMENTS

| | | | |
|---|---|---|---|
| 1,818,073 | 8/1931 | Long | 117/93.31 |
| 3,008,242 | 11/1961 | Sites et al. | 117/93.31 |
| 3,361,842 | 1/1968 | Applegath et al. | 117/93.31 |
| 3,502,542 | 3/1970 | Wenisch | 117/93.31 |
| 3,531,317 | 9/1970 | Patheiger et al. | 117/93.31 |
| 3,551,235 | 12/1970 | Bassemir et al. | 117/93.31 |
| 3,551,311 | 12/1970 | Nass et al. | 117/93.31 |
| 3,650,885 | 3/1972 | Nass et al. | 117/93.31 |
| 3,655,823 | 4/1972 | Parker et al. | 117/93.31 |
| 3,673,140 | 6/1972 | Ackerman et al. | 117/93.31 |

FOREIGN PATENT DOCUMENTS

| | | | |
|---|---|---|---|
| 761,051 | 11/1956 | United Kingdom | 204/160.1 |

*Primary Examiner*—John H. Newsome
*Attorney, Agent, or Firm*—George D. Morris

[57] ABSTRACT

A topcoat is applied over a coating which has been gelled by actinic light and which is curable by ionizing irradiation. The gelled coating and the topcoat are exposed to ionizing irradiation to cure the gelled coating. It is preferred that the topcoat as applied be curable by ionizing irradiation so that it will also be cured during exposure to ionizing irradiation.

27 Claims, 2 Drawing Figures

Figure 1:
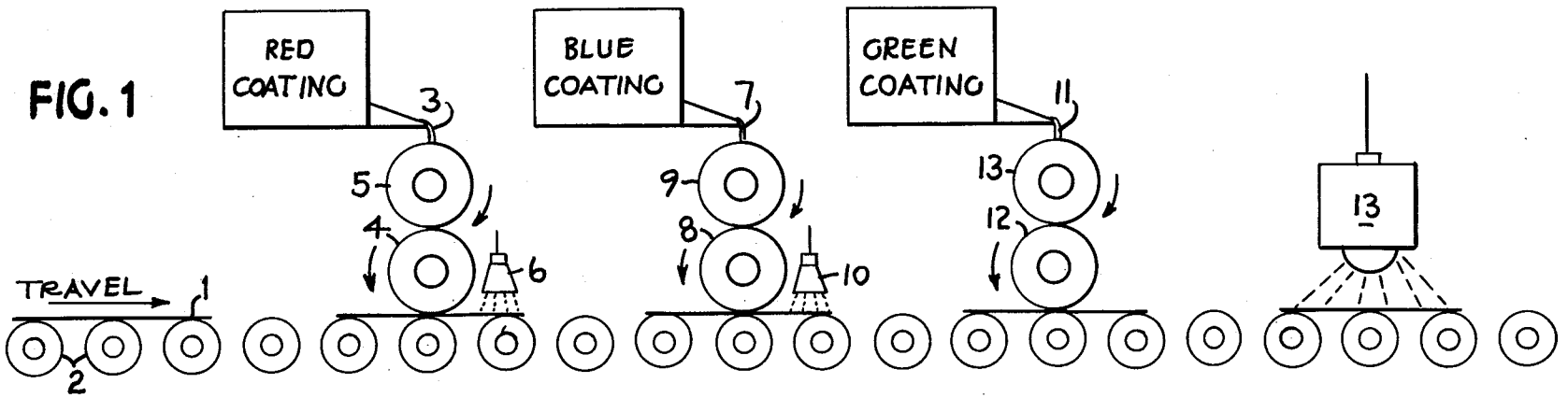

INVENTORS
MARCO WISMER
GENE GEREK
Christopher & Spencer
ATTORNEYS

PROCESS OF APPLYING AND CURING A PLURALITY OF COATINGS

CROSS-REFERENCE TO RELATED APPLICATION

This application is a continuation-in-part of Application Ser. No. 122,433, filed Mar. 9, 1971 now abandoned.

BACKGROUND OF THE INVENTION

In the coating industry, it is many times desirable to utilize a plurality of coatings on a substrate either for protection or to produce a decorative effect. In the past, the application of multiple coatings has been a very expensive process. The substrate would be passed through the first coating zone and then conveyed to a heating unit to cure the coating and then passed on to another coating zone and recycled back to the heating unit to cure the second coat and so on. The first coating must be made firm prior to the application of the second coating to the extent that it will not run into the second coating. Thus, a heating unit is necessary after each coating application to cure the coating and since the heating unit is generally expensive and requires a great deal of space it has been necessary to recycle the coated substrate back to the original heating unit rather than maintain a plurality of heating units placed after each coating applicator. This operation requires a great deal of time to continually recycle the coated substrate and heat harden each coating. Thus, a more desirable method is necessary.

A novel method has now been found which allows the coating to be hardened with a minimum of expense using a minimum amount of equipment and space which alleviates the necessity of recycling the coated substrate through a heating unit and which further provides for vastly improved properties in the cured coatings.

The novel method of this invention comprises applying over a coating which has been gelled by actinic light and which is curable by ionizing irradiation, a topcoat and thereafter exposing the gelled coating and the topcoat to ionizing irradiation to cure the gelled coating. It is preferred that the topcoat be applied to the gelled coating, but it is permissible for other types of coatings to intervene so long as they are firm enough to receive the coatings applied to them without running. It is also preferred that the topcoat as applied be curable by ionizing irradiation so that during exposure to ionizing irradiation it will also be cured. It will be appreciated that the invention includes application of the topcoat over a plurality of coatings which have been gelled by actinic light and which are curable by ionizing irradiation and thereafter exposing the gelled coatings and the topcoat to ionizing irradiation to cure the gelled coatings.

By the term "gel" it is meant that the coating will be hardened so that it is not flowable although the coating will not be considered fully cured. The coating although not completely hard will not lose its definition upon the application of another coating which is wet or ungelled. By the term "cure" is meant that the coating will become cross-linked so as to exhibit the infusibility and insolubility in acetone customarily associated with thermoset resins.

Although any coating material which is gellable by actinic light and curable by ionizing irradiation may be used, the preferred coating materials are those containing crosslinkable ethylenically unsaturated materials such as polyfunctional acrylic resins such as difunctional acrylates and difunctional methacrylates, acryloxypivalyl acryloxypivalate, bis-(acryloxyethyl)-hexahydrophthalate, bis-(acryloxyethyl)phthalate and the like.

The most preferred acrylic materials are those described in U.S. Pat. Nos. 3,455,802, 3,485,732, 3,455,801 and 3,485,733, which disclosures are incorporated by reference herein.

The topcoating material may be any coating that does not degrade upon exposure to ionizing irradiation. Although the topcoating material as applied may be incapable of becoming cured by ionizing irradiation, it is preferred that it be curable upon exposure to such irradiation. The topcoating material may conveniently be any of the coating materials which are gellable by actinic light and curable by ionizing irradiation as described above.

The coating materials and topcoating materials may contain additional components designed to upgrade the coating for its intended purpose such as fillers, plasticizers, dyes, pigments, etc. These compositions may be in the form of solvent solutions in any solvent or they may be monomeric components which require no solvents. They may be clear or they may be pigmented, dyed or otherwise colored. Flatting pigments are often present in the topcoating material.

It is noted that, if desired, photosensitizers may be added to the coating composition. Typical photosensitizers are benzoin, benzophenone, hydroxy-benzophenone, and the like. The photosensitizers are most effective when used in amounts of about 0.1 percent to about 2.0 percent by weight.

As the multiple coated articles find utility as decorative materials, the preferred coatings and/or topcoatings contain dyes or pigments. In this way, many coatings of different color may be superimposed on one another or applied to adjacent areas. It is noted, also, that the coatings and topcoating need not be continuous. Some layers, or all layers, may be discontinuous.

The coatings and topcoatings may be applied to the substrate by any conventional coating method such as curtain coating, roll coating, spray coating, dip coating, printing methods, and the like. This process is particularly useful when the coatings and topcoatings are applied as printing inks by the conventional printing methods such as the typographic, letterpress, or relief method, the planographic or lithographic method, or the intaglio or gravure method of printing. The printing inks are generally quite thin such as 5 microns or less.

The substrate to be coated may be any material such as metal, wood, paper, plastic, or the like, either with or without previous coatings. The substrate may also be any size or shape. It is preferable, of course, to select a substrate which is not degradable by the actinic light or the ionizing irradiation.

In the preferred embodiment of this invention, the substrate is a metal, such as tinplate, tin-free steel, aluminum, cold rolled steel, and the like. It has long been desired in the metal decorating art to be able to overprint designs inexpensively and the method delineated herein is particularly suited to meet that need.

After every application of coating material which is gellable by actinic light and curable by ionizing irradiation, except perhaps the topcoating material, the coating is exposed to actinic light to gel the coating prior to the next coating step. The exposure of the coating to actinic light will gel the coating so that it will not run into the next coating when applied. There is no harm in gelling the topcoat with actinic light prior to exposure to ionizing irradition, but this is usually not necessary. As the topcoat will not be overcoated with another coating prior to exposure to ionizing irradiation, it need not be gelled prior to such exposure.

The coatings are gelled when exposed to actinic light such as ultra-violet light. In general, the use of wave lengths in which sensitivity to actinic light occurs is approximately 1,800 to 4,000 angstrom units. Various suitable sources of the actinic light are available in the art including, by way of example, quartz mercury lamps, ultra-violet cored carbon arcs, and high-flash lamps.

The time that each coating must be exposed to the actinic light prior to the next coating application may vary greatly according to the composition of the coating, the thickness of the coating, color of the coating, and light intensity but it is generally required to subject the coatings to actinic light for only a short while as the gelling occurs very rapidly. In most cases, the coating will gel in from 0.1 to about 2.0 seconds.

There is no limit on the number of total coating layers which may be applied as, using the method of this invention, the layers will not offset and the ionizing irradiation treatment will completely cure all the layers which are curable by such irradiation.

As the ultra-violet equipment necessary to provide gelling of the coatings is rather small in size, the space necessary for the multiple coatings is not prohibitive.

The multiple coating layers and preferably the topcoat are cured to a hard adherent composite by subjecting them to ionizing irradiation. It has been found that the pigmented coatings cure to a far greater degree when exposed to ionizing irradiation than when exposed to actinic light.

The term "irradiation", as used herein, means high energy radiation and/or the secondary energies resulting from conversion of electrons or other particle energy to X-rays or gamma radiation. While various types of irradiation are suitable for this purpose, such as X-rays and gamma rays, the radiation produced by accelerated high energy electrons has been found to be very conveniently and economically applicable and to give very satisfactory results. However, regardless of the type of radiation and the type of equipment used for its generation or application, the use thereof in the practice of the invention as described herein is contemplated as falling within the scope of this invention so long as the ionization radiation equivalent to at least about 25,000 electron volts.

While there is no upper limit to the electron energy that can be so applied advantageously, the effects desired in the practice of this invention can be accomplished without having to go to above about 20,000,000 electron volts. Generally, the higher the electron energy used, the greater is the depth of penetration into the massive structure of the materials to be treated. For other types of radiation, such as gamma and X-rays, energy systems equivalent to the above range of electron volts are desirable.

It is intended that the term "irradiation" include what has been referred to in the prior art as "ionizing radiation" which has been defined as radiation possessing an energy at least sufficient to produce ions or to break chemical bonds and thus includes also radiations such as "ionizing particle radiation" as well as radiations of the type termed "ionizing electromagnetic radiation".

The term "ionizing particle radiation" has been used to designate the emission of electrons or highly accelerated nuclear particles such as protons, neutrons, alpha-particles, deuterons, beta-particles, or their analogs, directed in such a way that the particle is projected into the mass to be irradiated. Charged particles can be accelerated by the aid of voltage gradients by such devices as accelerators with resonance chambers, Van der Graaff generators, betatrons, synchrotons, cyclotrons, etc. Neutron radiation can be produced by bombarding a selected light metal such as beryllium with positive particles of high energy. Particle radiation can also be obtained by the use of an atomic pile, radioactive isotopes or other natural or synthetic radioactive materials.

"Ionizing electromagnetic irradiation" is produced when a metallic target, such as tungsten, is bombarded with electrons of suitable energy. This energy is conferred to the electrons by potential accelerators of over 0.1 million electron volts (mev.). In addition to irradiation of this type, commonly called X-ray, an ionizing electromagnetic irradiation suitable for the practice of this invention can be obtained by means of a nuclear reactor (pile) or by the use of natural or synthetic radioactive material, for example, Cobalt 60.

Various types of high power electron linear accelerators are commercially available, for example, the ARCO type travelling wave accelerator, model Mark I, operating at 3 to 10 million electron volts, such as supplied by High Voltage Engineering Corporation, Burlington, Mass., or other types of accelerators as described in U.S. Pat. No. 2,763,609 and in British patent specification No. 762,953 are satisfactory for the practice of this invention.

The coating materials described herein will cure acceptably using any total dosage between about 0.1 megarad and about 100 megarads. A "rad" is defined as that amount of radiation required to supply 100 ergs per gram of material being treated and a "megarad" is $10^6$ rads. The total dosage is the total amount of irradiation received by the coating composition. It has been found that the coatings will cure to form excellent hard films at a total dosage of less than about 5 megarads.

In some cases, it may be desirable to topcoat the coatings with a heat curing varnish material. The varnish may be used as a protective coating and aids in obtaining a uniform glossy material. Any conventional radiation-sensitive varnish finish may be used as a topcoat such as nitrocellulose layers, acrylics, vinyls, alkyds and the like. The varnish is cured along with the other coating layers by ionizing irradiation.

The curing process involving ionizing irradiation is particularly advantageous for the printing process as conventional printing speeds are from 300 to 1500 feet per minute and pigmented coatings at that speed can be reasonably cured only by ionizing irradiation. In this way, the entire operation may be run at high speed and minimum expense as one conveyor may be used throughout the entire coating, gelling and curing process.

The principles of the invention are susceptible to incorporation into many embodiments.

In one embodiment a coating which is gellable by actinic light and curable by ionizing irradiation is applied to a substrate. The coating is then exposed to actinic light to gel the coating. A topcoat is applied to the gelled coating and the substrate, the gelled coating and the topcoat are exposed to ionizing irradiation to cure the gelled coating. In a preferred embodiment, the topcoat is also cured during the exposure.

In another embodiment, a coating which is gellable by actinic light and curable by ionizing irradiation is applied to a substrate. The coating is then exposed to actinic light to gel the coating. These two steps of applying the coating and exposing to actinic light to gel the coating are then performed a further $(n-1)$ times, where $n$ is a positive integer. A topcoat is applied to the gelled coatings and the substrate, the gelled coatings and the topcoat are exposed to ionizing irradiation to cure the gelled coatings. As before, it is preferred that the topcoat also be cured during the exposure to ionizing irradiation. Permissible values of $n$ include 1, 2, 3, 4, 5, 6 and even higher.

In still another embodiment, a coating which is gellable by actinic light and curable by ionizing irradiation is applied to a substrate. The coating is then exposed to actinic light to gel the coating. To the previously applied gelled coating a coating which is gellable by actinic light and curable by ionizing irradiation is applied. This coating is then exposed to actinic light to gel the coating. These two steps of applying the coating to the previously gelled coating and exposing to actinic light to gel the last applied coating are then performed a further $(n-2)$ times, where $n$ is a positive integer greater than 1, to form $n$ layers of gelled coatings. A topcoat is applied to the $n^{th}$ layer of gelled coating and the substrate, the gelled coatings and the topcoat are exposed to ionizing irradiation to cure the gelled coatings. Again, it is preferred that the topcoat also be cured during the exposure to ionizing irradiation. Permissible values of $n$ include 2, 3, 4, 5, 6, 7 and even higher.

Features of several of these embodiments may be combined into still further embodiments.

The multiple coating process may be illustrated by FIG. 1 of the drawing. In FIG. 1, substrate 1 which may be sheet material is carried by conveyor belt or web 2. The first coating material 3 is applied to one or both sides of substrate 1 by gravure roll 4 which is supplied with coating material by transfer cylinder 5. Although the first coating material is depicted as being red, any color coating may be substituted. The coated or printed substrate is then subjected to ultra-violet light or other actinic light from source 6 to gel said first coating. The first coating is then overprinted with coating material 7 which is depicted as having a blue color by gravure roll 8 which receives the coating material from transfer roll 9. The second overcoat is gelled by ultra-violet light or other actinic light from source 10. A third overprinting is depicted with a green coating material 11 being printed on to the coated substrate by gravure roll 12 with coating supplied from transfer roll 13. The entire composite is then subjected to ionizing irradiation from source 13 to cure all the coating layers.

Figure 2:
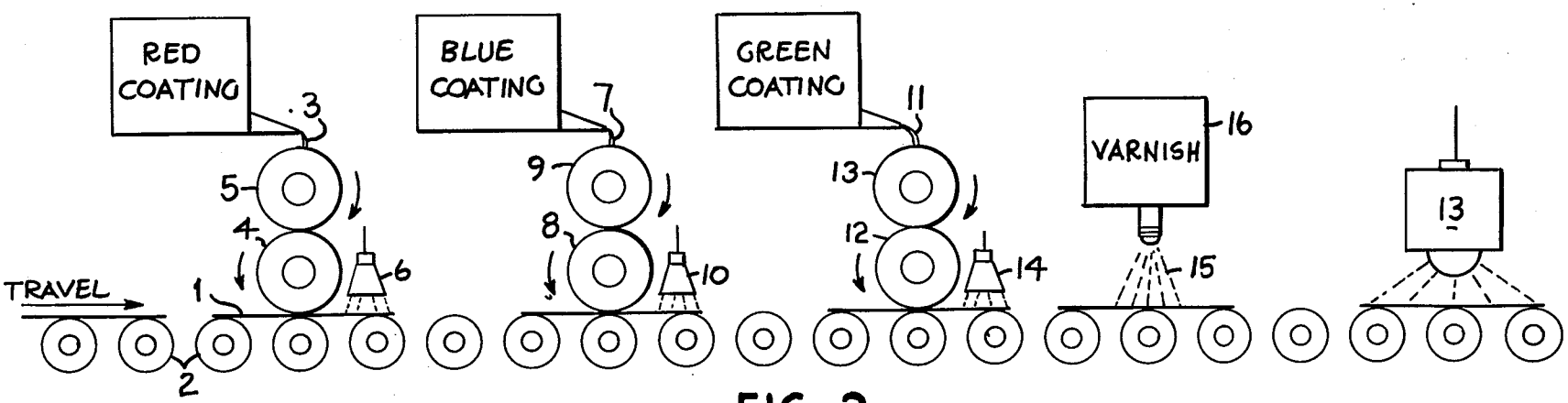

FIG. 2 depicts another embodiment of the invention wherein the red, blue and green coatings are printed on to substrate 1 and last coating (green) is subjected to ultra-violet light from source 14 to gel coating material 11 and overcoated with varnish 15 from applicator 16 prior to subjecting the entire composition to ionizing irradiation from source 13.

The composite articles produced by the method depicted above are very useful as printed articles such as multiple printed beverage containers and the like and for many other purposes for which more than one coating is required.

The following examples set forth specific embodiments of the instant invention, however, the invention is not to be construed as being limited to these embodiments for there are, of course, numerous possible variations and modifications. All parts and percentages in the Examples as well as throughout the specification are by weight unless otherwise indicated.

EXAMPLE 1

A multi-colored article was formed using the process described below:

An acrylic base material was printed with an ink material comprising acryloxypivalyl acryloxypivalate

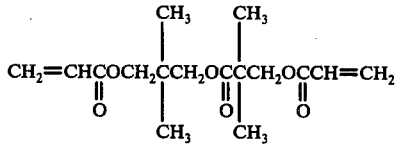

mixed with carbon black and 1 percent benzoin. Immediately following the application of the ink to the base material the ink was subjected to ultra-violet light for 2 passes at 15 feet per minute under a mercury lamp to gel the ink without curing it. Immediately following the gelling of the black ink, a second printing ink containing acryloxypivalyl acryloxypivalate mixed with phthalo blue pigment and 1 percent benzoin was applied through a screen to the gelled black ink and this coating was immediately gelled by the ultra-violet light and a third printing ink comprising acryloxypivalyl acryloxypivalate mixed with cabnium red pigment and one percent benzoin was applied through a screen and subsequently gelled with ultra-violet light. A varnish coat of clear acryloxypivalyl acryloxypivalate was then applied and the entire composite cured by subjecting to electron beam impingement at 500 kilovolts. The total dosage was 5 megarads.

The composite produced had excellent intercoat adhesion and had a hard surface which was multi-colored.

EXAMPLE 2

A multi-colored article is formed using the process described below:

An acrylic base material is printed with an ink material comprising bis-(acryloxyethyl)hexahydrophthalate mixed with iron oxide and one percent benzoin. Immediately following the application of the ink to the base material the ink is subjected to ultra-violet light at 15 feet per minute under a mercury lamp to gel the ink without curing. Immediately following the gelling of the ink, a second printing ink containing bis-(acryloxyethyl)phthalate mixed with a different coloring pigment and one percent benzoin is applied thereon and subsequently gelled with ultra-violet light. A clear coat of bis-(acryloxyethyl)hexahydrophthalate is then applied and the entire composite cured by subjecting to electron beam impingement at 500 kilovolts. The total dosage is 5 megarads.

The composite produced has excellent adhesion and a hard surface.

According to the provisions of the patent statutes, there are described above the invention and what are now considered to be its best embodiments. However, within the scope of the appended claims, it is to be understood that the invention can be practiced otherwise than as specifically described.

We claim:

1. A method comprising
a. applying over a coating which has been gelled by actinic light and which is curable by ionizing irradiation, a topcoat; and
b. exposing said gelled coating and said topcoat to ionizing irradiation to cure said gelled coating.

2. The method of claim 1 wherein said topcoat as applied is curable by ionizing irradiation and wherein said topcoat is cured during said exposure to said ionizing irradiation.

3. A method comprising
a. exposing a coating which is gellable by actinic light and curable by ionizing irradiaton, to actinic light to gel said coating;
b. applying to said gelled coating a topcoat; and
c. exposing said gelled coating and said topcoat to ionizing irradiaton to cure said gelled coating.

4. The method of claim 3 wherein said topcoat as applied is curable by ionizing irradiation and wherein said topcoat is cured during said exposure to said ionizing irradiation.

5. The method of claim 4 wherein said topcoat is a varnish.

6. The method of claim 5 wherein said varnish is a nitrocellulose lacquer.

7. The method of claim 5 wherein said varnish is an acrylic resin.

8. The method of claim 5 wherein said varnish is a vinyl lacquer.

9. The method of claim 3 wherein said coating contains a polyfunctional acrylic resin.

10. The method of claim 9 wherein said coating contains acryloxypivalyl acryloxypivalate.

11. The method of claim 3 wherein the actinic light is ultra-violet light.

12. The method of claim 11 wherein the wave length of the ultra-violet light is in the range of from about 1800 to about 4000 angstrom units.

13. The method of claim 3 wherein said gelled coating and said topcoat are exposed to ionizing irradiation in the amount of from about 0.1 to about 10 megarads.

14. The method of claim 3 wherein said coating and said topcoat are applied by printing methods.

15. A method of coating a substrate comprising:
a. applying to said substrate a coating which is gellable by actinic light and curable by ionizing irradiation;
b. exposing said coating to actinic light to gel said coating;
c. applying to said gelled coating a topcoat; and
d. exposing said substrate, said gelled coating and said topcoat to ionizing irradiation to cure said gelled coating.

16. The method of claim 15 wherein said topcoat as applied is curable by ionizing irradiation and wherein said topcoat is cured during said exposure to said ionizing irradiation.

17. A method of coating a substrate comprising:
a. applying to said substrate a coating which is gellable by actinic light and curable by ionizing irradiation;
b. exposing said coating to actinic light to gel said coating;
c. sequentially performing steps *a* and *b* a further $(n-1)$ times, wherein $n$ is a positive integer;
d. applying to the gelled coatings a topcoat; and
e. exposing said substrate, said gelled coatings and said topcoat to ionizing irradiation to cure said gelled coatings.

18. The method of claim 17 wherein said topcoat as applied is curable by ionizing irradiation and wherein said topcoat is cured during said exposure to said ionizing irradiation.

19. The method of claim 17 wherein said substrate is metal, wood, paper or plastic.

20. A method of coating a substrate comprising:
a. applying to said substrate a coating which is gellable by actinic light and curable by ionizing irradiation;
b. exposing said coating to actinic light to gel said coating;
c. applying to the previously gelled coating a coating which is gellable by actinic light and curable by ionizing irradiation;
d. exposing the coating applied in step (c) to actinic light to gel said coating applied in step (c)
e. sequentially performing steps (c) and (d) a further $(n-2)$ times, wherein $n$ is a positive integer greater than 1, to form $n$ layers of gelled coatings;
f. applying to the $n^{th}$ layer of gelled coating of topcoat; and
g. exposing said substrate, said gelled coatings and said topcoat to ionizing irradiation to cure said gelled coatings.

21. The method of claim 20 wherein said topcoat as applied is curable by ionizing irradiation and wherein said topcoat is cured during said exposure to said ionizing irradiation.

22. The method of claim 20 wherein said substrate is metal, wood, paper or plastic.

23. The method of claim 1 wherein said gelled coating contains pigments.

24. The method of claim 3 wherein said gellable coating contains pigments.

25. The method of claim 15 wherein said gellable coating contains pigments.

26. The method of claim 17 wherein said gellable coating contains pigments.

27. The method of claim 20 wherein said gellable coating contains pigments.

* * * * *

UNITED STATES PATENT AND TRADEMARK OFFICE

CERTIFICATE OF CORRECTION

PATENT NO. : 4,070,497

DATED : January 24, 1978

INVENTOR(S) : Marco Wismer and Gene Gerek

It is certified that error appears in the above-identified patent and that said Letters Patent are hereby corrected as shown below:

Column 8, line 37, "of" should be --a--.

Signed and Sealed this

*Thirtieth* Day of *May 1978*

[SEAL]

*Attest:*

RUTH C. MASON
*Attesting Officer*

LUTRELLE F. PARKER
*Acting Commissioner of Patents and Trademarks*